US005593734A

United States Patent [19]

Yuan et al.

[11] Patent Number: 5,593,734

[45] Date of Patent: Jan. 14, 1997

[54] MULTIPLE INLET FLOW DISTRIBUTOR FOR LIQUIDS

[75] Inventors: Sinh-Luh Yuan, Webster; David W. Gruszczynski, II, Rochester, both of N.Y.

[73] Assignee: Eastman Kodak Company, Rochester, N.Y.

[21] Appl. No.: 597,750

[22] Filed: Feb. 7, 1996

Related U.S. Application Data

[63] Continuation-in-part of Ser. No. 281,869, Jul. 28, 1994, abandoned, which is a continuation of Ser. No. 30,997, Mar. 12, 1993, abandoned.

[51] Int. Cl.[6] ..... B05D 1/30

[52] U.S. Cl. ..... 427/420; 427/402; 118/410; 118/411; 118/324; 118/DIG. 4; 425/462

[58] Field of Search ..... 427/420, 402; 425/462; 118/410, 411, 324, DIG. 4

[56] References Cited

U.S. PATENT DOCUMENTS

| | | | |
|---|---|---|---|
| 2,681,294 | 6/1954 | Beguin . | |
| 2,734,224 | 2/1956 | Winstead . | |
| 3,381,336 | 5/1968 | Wells . | |
| 3,825,645 | 7/1974 | Fayet . | |
| 4,017,240 | 4/1977 | Nelson . | |
| 4,287,240 | 9/1981 | O'Connor . | |
| 4,465,707 | 8/1984 | Tanaka et al. . | |
| 4,550,681 | 11/1985 | Zimmer et al. . | |
| 4,623,501 | 11/1986 | Ishizaki | 118/410 |
| 4,675,208 | 6/1987 | Kageyama et al. . | |
| 5,011,714 | 4/1991 | Takahashi et al. . | |
| 5,143,758 | 9/1992 | Devine | 427/420 |
| 5,234,500 | 8/1993 | Korokeyi | 118/325 |

FOREIGN PATENT DOCUMENTS

| | | |
|---|---|---|
| 3723149 | 1/1988 | Germany . |

*Primary Examiner*—Katherine A. Bareford
*Attorney, Agent, or Firm*—Arthur H. Rosenstein

[57] ABSTRACT

A liquid flow distribution apparatus for forming highly uniform liquid layers on substrates without stagnation within a flow distribution cavity of the apparatus. A primary cavity has a primary inlet means and a plurality of secondary inlet conduits which terminate in angled secondary ports in the cavity wall. Each of the secondary ports is angled away from the primary inlet means. The apparatus can be used under varying rheological conditions.

9 Claims, 3 Drawing Sheets

MULTIPLE INLET FLOW DISTRIBUTOR FOR LIQUIDS

CROSS-REFERENCE TO RELATED APPLICATION

This is a Continuation in Part of U.S. Ser. No. 08/281,869 filed 28 Jul. 1994, now abandoned, entitled, "LIQUID FLOW DISTRIBUTION APPARATUS AND METHOD" by Yuan et al which is a Rule 62 Continuation of U.S. Ser. No. 08/030,997 filed 12 Mar. 1993, entitled, "LIQUID FLOW DISTRIBUTION APPARATUS AND METHOD" by Yuan et al, abandoned 1 Aug. 1994.

FIELD OF INVENTION

This invention relates to an apparatus and method for distribution of liquid flow. More particularly, it relates to an apparatus and method of improved versatility for coating or casting liquid compositions on a substrate.

BACKGROUND OF THE INVENTION

The coating and casting layers of liquid compositions on a substrate are practiced in many industries. For instance, photographic films and papers are made by coating liquid photographic compositions on a moving support web to form wide, long rolls which are subsequently cut into the desired roll or sheet formats. A product may contain as many as fifteen to twenty discrete layers which must be of uniform thickness, both widthwise and lengthwise.

Photographic coating of aqueous compositions commonly uses a slide hopper to coat multiple layers of photographic liquids on a moving web of plastic or paper. Slide hoppers are useful for either bead coating or curtain coating, as disclosed, e.g., in U.S. Pat. No. 4,287,240 to O'Connor, which is hereby incorporated by reference. The slide hopper comprises an elongated body which is positioned transverse to the direction of coating. The body has a smooth, inclined, upper surface, or "slide", down which the coating liquid flows to the moving support web. The interior of the body contains one or more elongated transverse flow distribution conduits or "cavities". Coating liquid is supplied to the hopper through an inlet conduit in the body which terminates in an inlet port in the cavity and which feeds liquid to the middle or to one end of the cavity. Coating liquid passes from this cavity to the slide surface through an elongated outlet slot in the body which communicates with both the cavity and the slide surface over substantially the entire length of the cavity.

The opening of the elongated outlet slot onto the slide surface is rectangular with a uniform height on the order of ten thousandths of an inch and with a length of fifty inches or more. The slot must be supplied with liquid at a uniform rate over its entire length in order to form coated layers of uniform thickness. Conventionally, the cavity shape is correlated with the slot dimensions to provide a hopper which is satisfactory for given rheological conditions including viscosity and density of the coating liquid, and volumetric flow rate. However, when used under different conditions, as in the coating of different liquid compositions, this cavity and slot design cannot provide the same high uniformity.

In a distribution cavity which has a constant cross-sectional area, the drop in pressure with distance from a central feed inlet is accompanied by a drop in flow rate transversely along the length of the cavity. This results in non-uniform delivery of liquid to the outlet slot and consequently, a non-uniform thickness in the layer coated on the support. It also results in regional stagnation of flow along the wall of the cavity, a serious problem in the photographic industry. Since many photographic coating liquids contain gelatin they will solidify if allowed to stagnate. This gives rise to irregularities in the cavity walls and can cause transverse thickness variation streaks in the coating. Stagnant regions can also allow clots of partially-solidified coating liquid to form which an break loose as slugs in the coating. In addition, coating liquid which escapes the stagnation regions may have undergone a change in photosensitivity because of extended residence time in the hopper. This can cause photographic non-uniformity.

It is known to provide multiple inlet conduits for coating liquid as disclosed, for example, in U.S. Pat. No. 4,623,501 to Ishizaki. This patent discloses "auxiliary supply pipes" at both ends of the cavity, but fails to recognize that this can create areas of stagnation along the cavity wall between the auxiliary pipes and the central pipe and non-uniform distribution of flow into the slot, which could result in detects or non-uniform thickness in mid portions of the coating.

PROBLEM TO BE SOLVED BY THE INVENTION

A need exists for an apparatus for distribution of liquid flow in coating hoppers and dies which can be used at different flow rates and with liquid compositions having different rheological properties to form highly uniform liquid layers and without substantial retrograde flow or stagnation in the distribution cavities.

SUMMARY OF THE INVENTION

The multiple inlet flow distributor of the invention comprises:

a) a body member;

b) an elongated flow distribution cavity defined within said body member, said cavity having first and second opposite ends and a cavity wall;

c) an elongated outlet slot extending from and along said cavity for delivering liquid toward the exterior of said body member;

d) primary inlet means for feeding liquid into said cavity and causing transverse flow of liquid in said cavity; and e) secondary inlet means including one ore more angled ports within said body member for introducing liquid into said cavity at spaced apart positions, each such port being angled to direct liquid flow transversely away from said primary inlet means and being spaced apart from the ends of the cavity.

The method of the invention is a method for coating a liquid composition as a uniform layer on a substrate by means of a coating hopper having an elongated flow distribution cavity extending transversely within said hopper and communicating throughout its length with an elongated outlet slot opening on an exterior surface of the hopper, said cavity having a central region and opposite ends, which comprises:

a) introducing a primary stream of the liquid composition to the central region of said elongated cavity and thereby causing said composition to flow transversely within the cavity;

b) introducing secondary streams of the liquid composition to the cavity between the central region and the ends thereof concurrent with the transverse flow of said primary stream in said cavity, each of said secondary streams being fed to said cavity at an angle toward and at a position spaced apart from the nearest end of said cavity; and the flow rates of said streams being selected to prevent or reduce stagnation of flow within the cavity.

ADVANTAGEOUS EFFECT OF THE INVENTION

The multiple inlet flow distributor apparatus and the method of the invention provide advantages of versatility in the coating and casting of liquid compositions on substrates. They make it possible to coat liquid compositions of different rheological properties in layers of uniform thickness without having to modify the apparatus for changes in the liquid compositions or the coating conditions. They provide uniform shear rate in the distributor cavities and uniform lay down of the coating liquid on the support. they reduce or eliminate retrograde flow and stagnation of flow in the cavities and, in particular, confine any such problems to the edges of the coated substrate so that unsatisfactorily coated film, if any, can be trimmed from the edges without excessive cost.

DETAILED DESCRIPTION OF THE INVENTION

Figure 1:
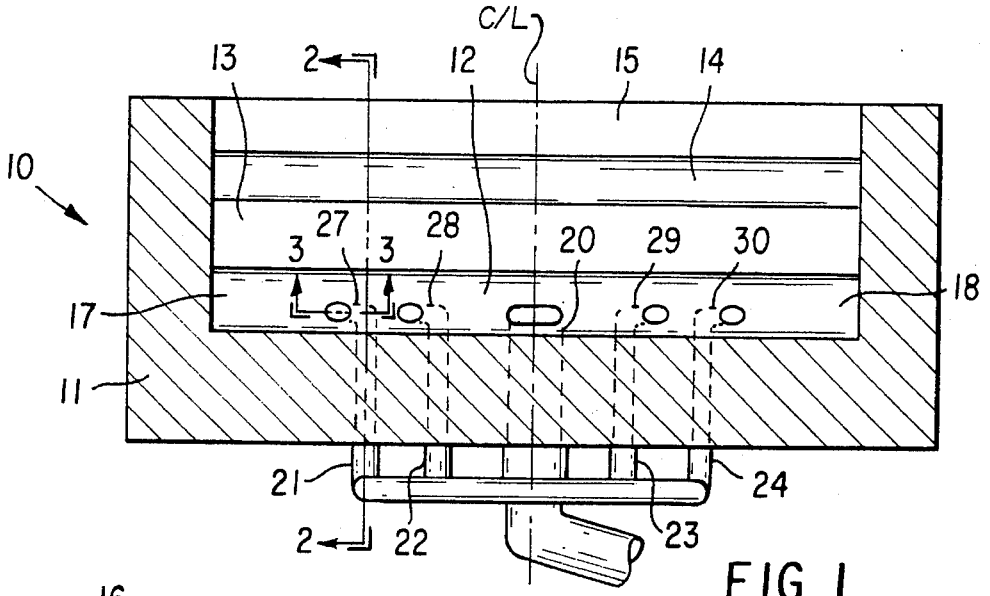
FIG. 1 is a sectional view in elevation of a distributor apparatus of the invention.
Figure 2:
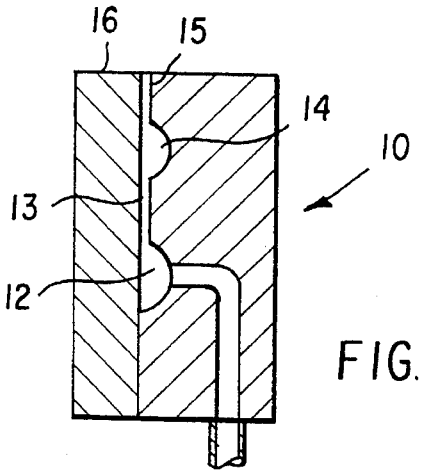
FIG. 2 is a cross-section along line 2—2 of FIG. 1.
Figure 3:
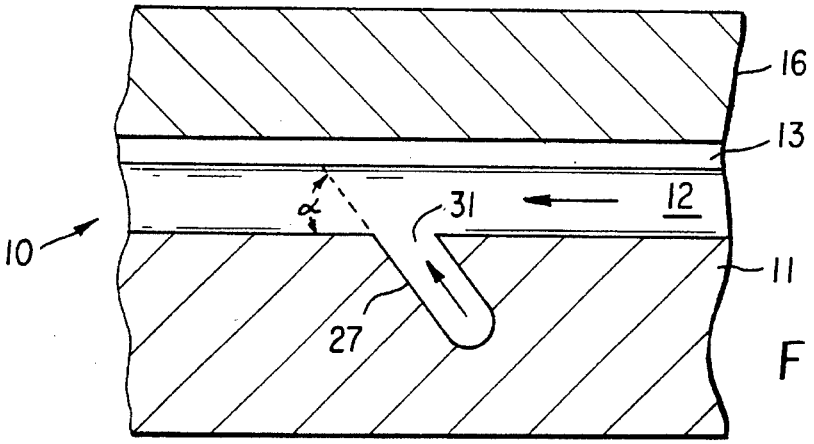
FIG. 3 is an enlarged sectional view of a portion of the distributor along line 3—3 of FIG. 1.

In FIGS. 1, 2 and 3 the liquid distributor 10 of the invention comprises a body member 11 formed of steel, titanium or the like. It has an elongated main or primary distribution cavity 12 of semicircular cross section, an outlet slot 13 connecting cavity 12 with an elongated redistribution or secondary cavity 14 and a slot 15 for delivery of liquid coating composition from cavity 14 to the exterior of the body member of distributor 10. Liquid flowing from the distributor 10 flows onto a slide surface 16.

A primary inlet conduit 20 feeds a liquid coating composition into the central region of cavity 12 and thereby causes transverse flow of liquid in the cavity toward each end thereof, as well as flow into the slot 13. The terminal portion of conduit 20 which communicates with an opening in the wall of cavity 12 is perpendicular to the long dimension, i.e., the transverse direction, of the cavity. This terminal portion of the central inlet conduit with its associated opening in the cavity wall is called a non-angled port, the term "port" being used herein to include both the opening in the cavity wall and the terminal portion of the inlet conduit which connects with the opening. As discussed further below, the terminal portions of certain other inlet conduits join the opening at an incline or angle. These are called angled ports.

The distributor 10 also has secondary inlet conduits 21, 22, 23 and 24. These conduits include and terminate in angled ports 27, 28, 29 and 30, respectively. In FIG. 3 which is a sectional view of a portion of distributor 10 along line 3—3 of FIG. 1, the angled port 27 includes an opening 31 in the wall of cavity 12. The other angled ports include respective openings in the wall of the cavity. Thus each port 27, 28, 29 and 30 is angled to direct liquid flow into the cavity transversely away from the primary inlet conduit 20. The stream exiting from each angled port merges concurrently with the main transverse stream from the primary inlet conduit 20. This avoids the generation of recirculation or retrograde flow regions inside the elongated cavity 12. As FIG. 1 shows, all of the angled ports are spaced apart from the ends of cavity 12.

As shown in FIG. 1, cavity 12 is an elongated flow distribution conduit extending transversely to the direction of coating. The cross-sectional area of the cavity can be semicircular as shown in FIG. 2 or can be circular, rectangular or of other shape. The cavity can have a uniform cross-sectional area over its length or the cross sectional area can vary as, for example, in a tapered cavity. It is approximately symmetrical with respect to imaginary centerline C/L and has opposite ends 17 and 18. Non-angled port 20 is located substantially at, and substantially parallel to, the center plane of cavity 12, indicated as centerline C/L in FIG. 1. Angled ports 27, 28, 29 and 30 are angled preferably at 30 to 60 degrees to the wall of cavity 12, as indicated by angle alpha in FIG. 3, creating an included acute angle between each angled port and cavity wall.

Flow rates of coating liquid through ports 27, 28, 29 and 30 are adjustable relative to each other, either by sizing of their respective inlet conduits, or be adjustment of individual control valves in the conduits (not shown). The flow volumes are set so that flow at all points on the cavity wall is laminar and away from non-angled port 20. Preferably, the shape of the junctures of angled ports 27, 28, 29 and 30, and the cavity wall is a compound curve. The juncture can be sharp on its upstream side and then rounded or feathered progressively around its periphery to provide a smooth entry for coating liquid into the cavity. This shape will promote a laminar merging of flows within the cavity. The juncture of non-angled port 20 and the cavity wall preferably also is rounded.

In the apparatus of FIGS. 1–3, flow from the non-angled port spreads in the direction of coating and also transversely toward both ends of the cavity, and fills the outlet slot 13 over at least a portion of the slot. The flow rate for the non-angled port is set to fill a portion of the slot at least as wide as the distance between the two adjacent angled ports. Accordingly, transverse flow from the non-angled port merges concurrently with transverse flows from the non-angled port and from the adjacent angled ports. Flow from each angled port spreads toward both the slot and the nearest end of the cavity, and joins with flow from the next adjacent angled port. Liquid from the farthest angled port flows toward the outlet slot and toward the end of the cavity where it is diverted into the outlet slot. In this way, the cavity and the outlet slot are filled uniformly by a plurality of flows of coating liquid without creation of areas of retrograde flow or stagnation which can occur in known liquid distribution apparatus where countercurrent transverse flows meet and form a stagnant region.

The endmost angled port on each side of the cavity 12 is substantially spaced apart from the closest end of the cavity. The position of the farthest angled inlet ports apart from the end of the cavity should not exceed 90% of the distance from the primary inlet to the end of the cavity. Thus, if the cavity is 60 inches wide, the inlet must be at least 3 inches away from the end of the cavity. This avoids or reduces stagnation of flow or non-uniform flow rates in regions of the cavity that coat the main area of the substrate. Accordingly, if any stagnation should occur in the apparatus of the invention, it will occur only at the ends of the cavity. Hence, any non-uniform coating will be only along the edges of the coated substrate and can be trimmed without losing the main area of the coated product.

The apparatus of the invention provides marked improvement over the prior art even with only two angled ports. Additional angled ports, however, provide further improvement. FIG. 1 shows an embodiment of the invention having four angled ports. For wide hoppers or dies even more angled ports, i.e., six or eight are advantageous.

Figure 4:
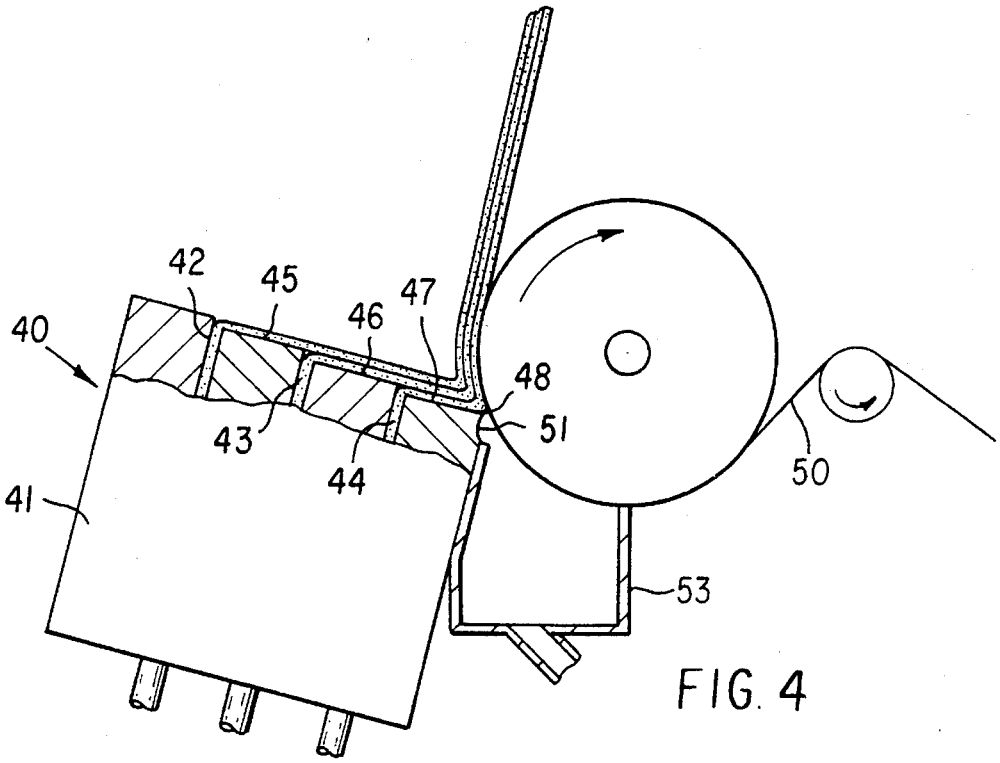
FIG. 4 is a schematic illustration, partly in section, of a slide hopper apparatus for multilayer coating of photographic films and papers.

FIG. 4 illustrates one way in which a liquid distribution apparatus of the invention can be employed, namely, in the multilayer coating of a photographic support web using a multi slot slide coating hopper. In FIG. 4, the slide hopper 40 is formed by joining a plurality of distributor means as in FIGS. 1–3 to form a body member 41 having a plurality of slots 42, 43 and 44, each with one or more distribution cavities (not shown) as in FIGS. 1–3. Liquid coating compositions, such as silver halide emulsions, are continuously pumped by metering or constant discharge pumps not shown in the drawing into the main distribution cavity for each slot. Body member 41 in FIG. 4 is formed by joining together four sections which function together as a single body member containing a plurality of cavities, slots, inlet means and ports, as will be discussed hereinafter. The composition pumped into the cavities is forced by the pump pressure from the cavity through slots 42, 43 and 44 and onto downwardly inclined slide surfaces 45, 46 and 47. The composition flows down the slide by gravity into a coating bead 48 which is formed between the surface of the web 50 and the lip or end 51 of the lower-most slide surface 47.

The moving web 50 contacts the coating bead 48, receives the superimposed layers of coating composition on its surface, and moves to subsequent operations such as chill setting and drying of the coatings. FIG. 4 also shows a means commonly used in bead coating, namely, a vacuum chamber 53 which serves to stabilize the coating bead. Such a vacuum chamber is disclosed, for example, in the patent to Beguin, U.S. Pat. No. 2,681,294, incorporated herein by reference.

Figure 5:
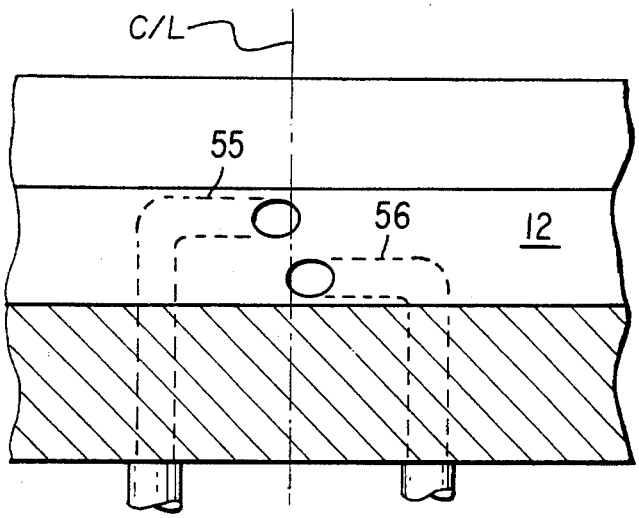
FIG. 5 shows an alternative form of the primary inlet means of the apparatus of the invention.

FIGS. 1 and 2 show a preferred embodiment wherein the primary inlet means is the single non-angled port which is positioned along the centerline C/L. FIG. 5 illustrates schematically a portion of another embodiment of the apparatus of the invention in which the primary inlet means comprises two central angled ports 55 and 56 which are positioned side by side or slightly offset. Ports 55 and 56 which are positioned in the central region of cavity 12 are angled to direct the flow of liquid past each other and toward opposite ends of cavity 12. The flows, however, should meet at least over a short distance so that no stagnant area lies between them.

FIGS. 1, 2 and 3 of the drawing show the preferred embodiment of the invention wherein the primary inlet means and the angled ports each introduce liquid into the cavity in a direction approximately perpendicular to the direction of flow in the outlet slot 13. This facilitates the uniform delivery of liquid to the slot. If desired however, the liquid streams can enter the cavity at other positions along the cavity wall.

It is known to locate the primary inlet conduit for a coating hopper at one end of the cavity, rather than at or near the center. A primary inlet means for the apparatus of the present invention can likewise be at one end of the cavity. It is also know to provide multiple cavities and slots in a multi-slot, multi-slide hopper for coating a plurality of layers simultaneously. See, e.g., U.S. Pat. No. 3,508,947 to Hughes, incorporated hereby by reference. Extrusion hoppers or radius lip hoppers are also know in the art. These are useful especially when coating liquid compositions having volatile solvents, as in the coating of magnetic recording media. The multiple inlet flow distributor of the present invention can be used with any of such coating hoppers.

One of the requirements for a liquid distribution apparatus is that it be easily purgeable, for example, at the start of a coating operation or when changing the coating composition. In the apparatus of the present invention, which has more inlet lines or conduits than a conventional single-inlet liquid distributor, the additional lines increase the volume, the purge times for the apparatus of the invention are substantially the same as for a single-inlet apparatus. This is demonstrated by the following example which describes purging tests carried out with a dual-cavity fluid distributor of the structure shown in FIG. 1.

EXAMPLE 1

The test apparatus according to FIGS. 1 and 2 is made of stainless steel and the geometries of the primary distribution cavity 12 and the secondary cavity 14 are uniform along the width of the distributor 10. The central non-angled port 20 has a cross-sectional are of 0.5 square inches, and the angled ports 27, 28, 29 and 30 each have a cross-sectional area of 0.11 square inches. The angled ports are regulated by a needle valve at each conduit of the ports. The angle between each angled port 27–30 and the primary distribution cavity is 30 degrees. Observation of fluid flow and purging performance is made possible by using a clear plastic cover bar with the stainless steel distributor.

In the distributor employed in the tests and the volume of the distribution chamber, which consists of the cavities and slots, is approximately 6.9 $in^3$, while the additional delivery lines have a total volume of 5.3 $in^3$. To determine the effect of the additional volume on the purging capability of the apparatus, flow visualization experiments were conducted with the arrangement of ports as shown in Table 1.

TABLE 1

| | Open Port |
|---|---|
| Case I | 20 |
| Case II | 20, 28, 29 |
| Case III | 20, 27, 28, 29, 30 |

The indicated open ports are fully open, and those not indicated are fully closed. Case I simulates a conventional; single-inlet, center-fed fluid distributor and Case III simulates an apparatus of FIG. 1. In these tests dyed water is purged by a mixture of glycerin and water. Conditions of the tests are shown in Table 2. They are representative of the pre-coat flow conditions inside a fluid distributor (coating hopper) in the coating of liquid compositions on photographic support webs.

TABLE 2

| Run | Viscosity cP | Flowrate cc/min |
|---|---|---|
| 1 | 6.3 | 5000 |
| 2 | 6.3 | 6190 |
| 3 | 6.4 | 6366 |
| 4 | 50.8 | 1207 |

The time needed to purge the dyed water from the distributor is estimated by visual examination of the fluid chamber. Table 3 lists the measurements of purging time, in seconds, for the three cases. As shown, the differences in purging time, for the same flow condition, in the three cases are insignificant.

TABLE 3

| Run | Case I | Case II | Case III |
|---|---|---|---|
| 1 | 25 | 24 | 22 |
| 2 | 28 | 28 | 22 |
| 3 | 32 | 36 | 34 |
| 4 | 108 | 120 | 118 |

It can be concluded that the opening of more ports does not adversely affect the purging capability of a fluid distributor. For the conditions used in these tests, no recirculation region was observed at the ends of the distributor and no recirculation region was observed between any two ports.

Prior art fluid distributors function well only under the limited coating conditions for which the distributor is designed, while the apparatus of the invention is more versatile. One indicator for the coating conditions is the cavity Reynolds number, $Re_{cav}$, which is defined as:

$$Re_{cav}=rQD/(mA)$$

where Q is the volumetric flowrate of a fluid, r is the fluid density, m is the fluid dynamic viscosity, A is the cross-sectional area of the distribution chamber, and D is the characteristic length of the cross-section of the chamber.

An important indicator of good performance or flow distribution capacity of a liquid distributor is the pressure ration, PR. This ration is defined as $P_{cav}/P_{avg}$, where $P_{cav}$ is the maximum pressure drop within the main distribution cavity of the distributor and $P_{avg}$ is the average pressure within the cavity. In general, the smaller the value of PR, the better the flow distribution. The following example describes tests conducted with the apparatus of FIG. 1 which demonstrate the low value of PR in the apparatus of the invention of a range of cavity Reynolds numbers.

EXAMPLE 2

To quantify the improvement in the distribution capability achieved by the apparatus of the invention, we have measured the fluid pressures at various widthwise locations inside the distribution cavity 12 of FIG. 1. A metal cover bar with pressure taps was used for pressure tests. The test conditions are combinations of the three cases of port arrangement, as listed in Table 1, and liquid flows at six fluid viscosities and eight flowrates, as listed in Table 4.

TABLE 4

| | |
|---|---|
| Viscosity (cP) | 16.5, 25.2, 47.5, 69.0, 82.5, 102.7 |
| Flowrate (cc/min) | 1000 to 8000 at an increment of 1000 |

Figure 6:
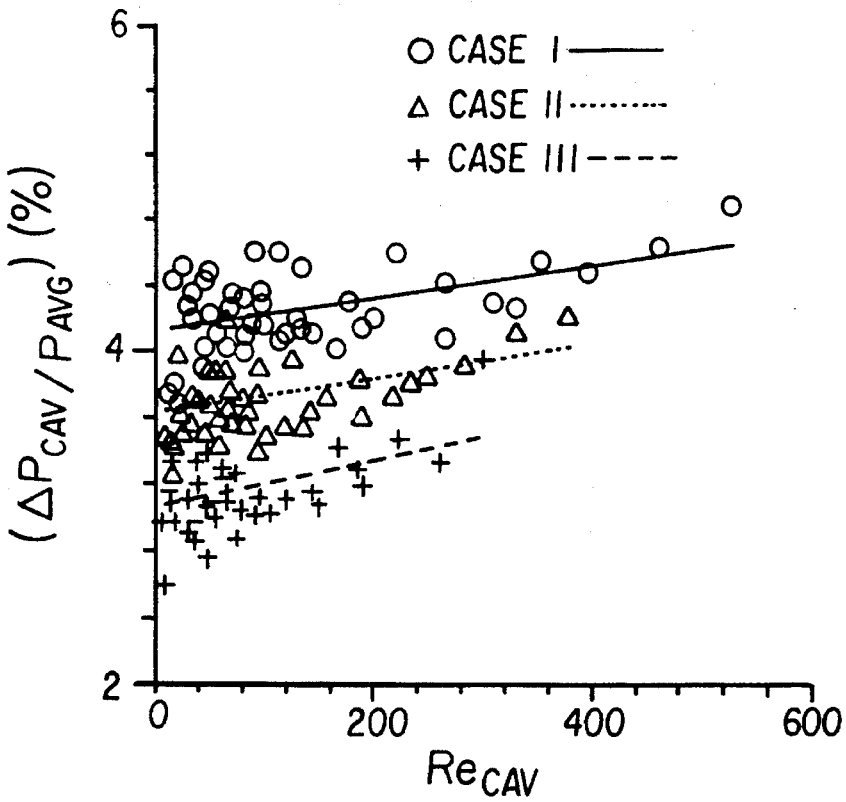
FIGS. 6 and 7 are plots of data obtained in comparative tests of an apparatus of the invention.

As mentioned above, the pressure ratio of PR is an indicator of a distributor's capability to distribute fluid. The lower the ratio, the better the capability. FIG. 6 of the drawing is a plot of the test results and shows the effect of the number of open ports on this ratio. The lines shown are the regression lines for the three cases respectively. It is evident that this ratio decreases as the number of inlet pens along the distribution chamber increases. Comparing Case I and III, a one per cent decrease in this ratio is evident at all test conditions.

Figure 7:
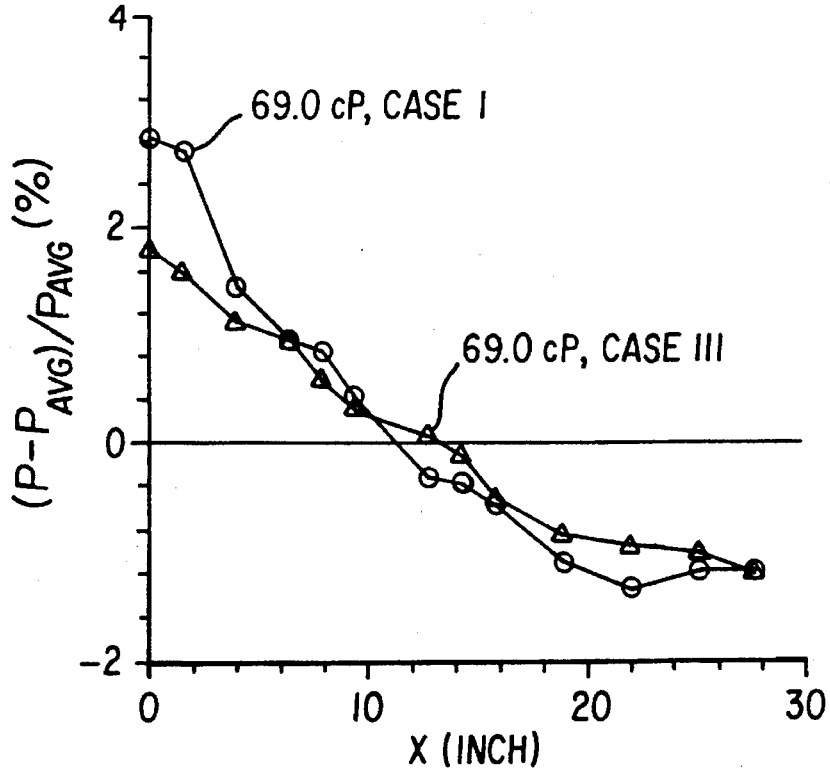

FIG. 7 is a plot of typical pressure measurements for case I and case III inside the fluid distributor. The measurements are for a test fluid of viscosity 69 cP, and at a flowrate of 6000 cc/min. In this figure, the measurements for only half of the distributor are shown. For case I, the port is located at 0 inch, and for case III, the ports are located at 0, 7.75 and 14.25 inches from the center of the cavity. The test results demonstrate at least two advantages of the apparatus of the invention:

(1) The inlet-jetting effect is more pronounced in case I, i.e., with a conventional single-inlet center-fed distributor. This is evident by the fact that the pressure curve for case I (single-inlet, center-led) has a high gradient in the cavity around the inlet, and low gradient close to the end of the cavity, while the pressure curve for case III (an embodiment of the invention) has a smaller and more uniform gradient over the whole width of the cavity.

(2) There is no indication of inlet effects associated with fluid inertia for case III having four angled ports. This is evident by the fact that the pressure gradients around these inlets blend well with the overall gradient of the pressure curve.

The above description and the drawings have emphasized the use of the apparatus and method of the invention with slide hoppers for coating photographic compositions. The apparatus and method, however, have broader utility. They are useful for liquid flow distribution in coating and casting a wide range of liquid compositions, for example, in single or multi-layer coating on substrates and in the casting of self-supporting films on casting surfaces. The liquid coating compositions can include aqueous compositions such as photographic emulsions and solvent coating compositions such as magnetic particle dispersions. Casting compositions can include, for example, cellulose acetate dopes and molten polymers. With all of these possible coating and casting procedures, the method and apparatus of the invention provide advantages in the uniformity of the coated layers, the versatility of use with different liquid compositions and flow rates and in eliminating or reducing retrograde flow and stagnation of flow in the distribution cavities of coating and casting hoppers and dies.

The invention has been described in detail with particular reference to prepared embodiments thereof, but it will be understood that variations and modification can be effected within the spirit and scope of the invention.

What is claimed is:

1. A method of coating a liquid composition as a uniform layer on a substrate by means of a coating hopper having an elongated flow distribution cavity extending transversely within said hopper and communications throughout its length with an elongated outlet slot opening on an exterior surface of the hopper, said cavity having a central region and opposite ends, comprising:

a) introducing a primary stream of the liquid composition to the central region of said elongated cavity and thereby causing said composition to flow transversely within the cavity;

b) introducing secondary streams of the liquid composition to the cavity between the central region and the ends thereof concurrent with the transverse flow of said primary stream in said cavity; and each of said secondary streams resulting in flow toward both the slot and a nearest end of the cavity and liquid from the farthest angled inlet port, angled with respect to the primary inlet, flows toward the outlet slot and toward the end of the said cavity on the same side of the primary inlet, said cavity being distinct from said outlet slot, the streams being fed to said cavity at an angle with respect to said cavity wall toward and at a position spaced apart from the end of said cavity on the same side as the primary inlet such that the position of the farthest angled inlet port, angled with respect to the primary inlet, in the cavity does not exceed 90% of the distance from the primary inlet to either end of the cavity; and flow rates of said streams being selected to prevent or minimize stagnation of flow within the cavity c) flow liquid composition from the cavity through the slot opening to the exterior surface of the hopper, and from the exterior surface of the hopper to the substrate.

2. A multiple inlet flow distributor for liquids, comprising:

a) one or more body members in a distributor;

b) an elongated flow distribution cavity defined within said body member, said cavity having first and second opposite ends and a cavity wall;

c) an elongated outlet slot extending from and along said cavity and distinct from said cavity for delivering liquid from said cavity toward an exterior of said distributor;

d) primary inlet means for feeding liquid into said cavity and causing transverse flow of liquid in said cavity;

e) secondary inlet means including one or more ports angled with respect to said cavity wall within said body member for introducing liquid into said cavity at spaced apart positions, such that the position of the farthest angled inlet port from the primary inlet in the cavity does not exceed 90% of the distance from the primary inlet to either end of the cavity, and at different flow rates from said primary inlet means, each such port being angled to direct liquid flow transversely away from said primary inlet means and being spaced apart from the ends of the cavity resulting in flow towards both the slot and the end of the cavity on the same side as the primary inlet, and liquid from the farthest angled inlet port flows toward the outlet slot and toward the end of the cavity such that the cavity directs the flow into the outlet slot; and f) control means for independent regulation of flow rate for said secondary inlet means.

3. A flow distributor according to claim 2, wherein said primary inlet means is a port non-angled in relation to said cavity wall which is parallel to a centerline between the ends of said cavity and feeds liquid to a central region of said cavity.

4. A flow distributor according to claim 3 having an equal number of said angled ports on both sides of said primary inlet means.

5. A flow distributor according to claim 2 wherein said primary inlet means comprises two central angled ports, each such port being angled with respect to said cavity wall to direct the flow of liquid past each other and toward opposite ends of said cavity.

6. A flow distributor according to claim 2 wherein said elongated cavity is a primary cavity which delivers liquid composition through said outlet slot to a secondary cavity and said secondary cavity delivers said liquid composition through another outlet slot to the exterior of said body member.

7. A flow distributor according to claim 2 wherein said slot has an elongated rectangular opening on a surface inclined with respect to said outlet slot on the exterior of said body member.

8. A flow distributor according to claim 7 wherein said body member is the body member of a coating hopper having a plurality of slide surfaces inclined with respect to said outlet slot and respective slots for delivering liquid composition to each slide surface.

9. A multiple inlet flow distributor for liquids, comprising:

a) one or more body members in a distributor;

b) an elongated flow distribution cavity defined within said body member, said cavity having first and second opposite ends, a central region, and a cavity wall;

c) an elongated outlet slot extending from and along said cavity and distinct from said cavity for delivering liquid from said cavity to an exterior of said distributor;

d) primary inlet means for introducing liquid into the central region of said cavity and causing said liquid to flow from said central region toward said slot and toward both ends of the cavity;

e) secondary inlet means including one or more ports angled with respect to said cavity walls positioned within said body member for introducing liquid into said cavity on both sides of said primary inlet means, each such port being angled to direct the flow of liquid toward the end of the cavity on the same side as the primary inlet of the cavity and the angled ports angled with respect to the primary inlet being spaced apart from the ends of the cavity; such that the farthest angled inlet port from the primary inlet has a position in the cavity which does not exceed 90% of the distance from the primary inlet to either end of the cavity; and f) control means for independent regulation of flow rate for said secondary inlet means.

* * * * *